US010988919B2

(12) United States Patent
Self et al.

(10) Patent No.: US 10,988,919 B2
(45) Date of Patent: Apr. 27, 2021

(54) SHOWER FLOOR ASSEMBLY

(71) Applicant: DLP Limited, Douglas (IM)

(72) Inventors: James Edward Self, Colby (IM); Iain Stuart Fenna, Peel (IM)

(73) Assignee: DLP Limited, Douglas (IM)

( * ) Notice: Subject to any disclaimer, the term of this patent is extended or adjusted under 35 U.S.C. 154(b) by 17 days.

(21) Appl. No.: 16/267,324

(22) Filed: Feb. 4, 2019

(65) Prior Publication Data

US 2020/0157794 A1 May 21, 2020

(30) Foreign Application Priority Data

Nov. 20, 2018 (GB) ..... 1818891

(51) Int. Cl.
*A47K 3/40* (2006.01)
*E03F 5/04* (2006.01)
(Continued)

(52) U.S. Cl.
CPC ..... *E03F 5/0408* (2013.01); *A47K 3/40* (2013.01); *E03C 1/01* (2013.01); *E03C 1/20* (2013.01); *E03C 1/22* (2013.01); *E03F 2201/00* (2013.01)

(58) Field of Classification Search
CPC ..... A47K 3/40; A47K 3/405; E03F 5/0408; E03F 2005/0415; E03F 2201/00;
(Continued)

(56) References Cited

U.S. PATENT DOCUMENTS 3,593,347 A 7/1971 Nemiroff
5,124,031 A * 6/1992 Dallmer ..... E03F 5/0407 137/362
(Continued)

FOREIGN PATENT DOCUMENTS

AU 710604 B2 4/1998
DE 1803775 A1 6/1969
(Continued)

OTHER PUBLICATIONS

UK Search Report dated Apr. 29, 2019, for British Patent Application No. GB1818891.2.
(Continued)

*Primary Examiner* — Charles P. Cheyney
(74) *Attorney, Agent, or Firm* — Wiggin and Dana LLP; Gregory S. Rosenblatt; Jonathan D. Hall

(57) ABSTRACT

A shower floor former assembly is provided which comprises a shower floor former having a non-circular waste-plate receiver and a drain waste plate which is dimensioned to be receivable in the waste-plate receiver. A centre point of the waste-plate receiver is offset from a centre point of the shower floor former, and the drain waste plate has a drainage aperture therethrough, a centre point of the drainage aperture being offset from a centre point of the drain waste plate. The drain waste plate is receivable in the waste-plate receiver in a first condition in which the centre point of the drainage aperture is offset relative to the centre point of the shower floor former. The drain waste plate is also receivable in the waste-plate receiver in a second condition in which the centre point of the drainage aperture is coincident with the centre point of the shower floor former.

13 Claims, 7 Drawing Sheets

(51) Int. Cl.
*E03C 1/01* (2006.01)
*E03C 1/20* (2006.01)
*E03C 1/22* (2006.01)

(58) Field of Classification Search
CPC ..... E03C 1/01; E03C 1/20; E03C 1/22; E04F 15/00; E04F 15/02
USPC ..... 4/612, 613
See application file for complete search history.

(56) References Cited

U.S. PATENT DOCUMENTS

| | | | | |
|---|---|---|---|---|
| 5,243,716 | A | 9/1993 | Zaccai | |
| 6,058,659 | A * | 5/2000 | Astrom | E04F 15/02 4/251.1 |
| 6,088,984 | A | 7/2000 | Kirby | |
| 6,647,565 | B2 * | 11/2003 | Smale | A47K 3/40 4/584 |
| 6,886,190 | B2 * | 5/2005 | Tompane | E03F 5/06 4/612 |
| 9,303,411 | B2 * | 4/2016 | Sjoden | E04D 13/1693 |
| 10,383,484 | B2 * | 8/2019 | Fraga | E03F 5/0408 |
| 2004/0111796 | A1 | 6/2004 | Tompane | |
| 2004/0255547 | A1 * | 12/2004 | Flowers | A47K 3/40 52/745.19 |
| 2006/0101777 | A1 * | 5/2006 | Lapointe | E04D 13/1693 52/404.1 |
| 2006/0213006 | A1 * | 9/2006 | Rush, Jr. | A47K 3/40 4/613 |
| 2008/0016614 | A1 * | 1/2008 | Daniels | A47K 3/40 4/613 |
| 2009/0119831 | A1 | 5/2009 | Grave | |
| 2011/0088160 | A1 | 4/2011 | Stimpson | |
| 2018/0110379 | A1 * | 4/2018 | Wadaga | E03C 1/12 |

FOREIGN PATENT DOCUMENTS

| | | | |
|---|---|---|---|
| DE | 3627807 | A1 | 2/1988 |
| DE | 10028256 | A1 | 1/2002 |
| EP | 0078593 | A1 | 5/1983 |
| EP | 0717951 | A1 | 6/1996 |
| EP | 2314190 | A2 | 4/2011 |
| GB | 915410 | A | 1/1963 |
| GB | 1508594 | A | 4/1978 |
| GB | 1591369 | A | 6/1981 |
| GB | 2401341 | B | 11/2004 |
| GB | 2406302 | B | 3/2005 |
| GB | 2431341 | A1 | 4/2007 |
| GB | 2431341 | C | 4/2007 |
| JP | 2007278032 | A | 10/2007 |
| WO | 2005/084506 | A1 | 9/2005 |
| WO | 2014096849 | A1 | 6/2014 |

OTHER PUBLICATIONS

European Search Report, dated Sep. 9, 2019, for EP Patent Application No. EP19152624.
Certificate of Registration, registration date Aug. 16, 2018, for EU Registered Community Design EP005610052-0001.

* cited by examiner

SHOWER FLOOR ASSEMBLY

CROSS REFERENCE TO RELATED APPLICATIONS

This application claims priority to British Application No. GB1818891.2, filed Nov. 20, 2018, the contents of which are incorporated by reference.

FIELD

The present invention relates to a shower floor former assembly preferably but not necessarily for forming a shower floor suitable for tiling. The invention further relates to a method of installing a shower floor former assembly to avoid joists thereunder.

BACKGROUND

Shower floor formers are used in shower areas where a wet-room type floor covering is to be applied. This is where the base of the shower is continuous with the surrounding floor, and therefore the shower floor former is provided to encourage water run-off into a shower waste.

The need to create a slope for water run-off means that the shower floor former has a depth which is greater than that of the floor boards or boarding which compose the floor prior to laying of the floor covering, such as tiles. Usually, the shower floor former is positioned directly onto underlying joists or floor supports, and the floor boards or boarding are then built up around the shower floor former to provide a flush surface.

The close proximity of the shower floor former to the joists presents a problem. If the pre-drilled drainage aperture is provided in a fixed position, then there is a risk that the shower waste will be in a position which overlaps with a joist. The joist must then be cut, weakening the support to the shower floor former.

Some shower floor formers are known which have circular drain plates having eccentrically positioned drainage apertures. This allows the position of the drainage aperture to be adjusted with respect to the joists, allowing the installer to position the shower waste in a position so as to avoid the joist.

The problem with such arrangements is that the drainage aperture is always in an eccentric position, and therefore there is no prospect of the drainage aperture being positionable in the perfect centre of the shower floor former. The finished shower floor will always look asymmetric and therefore unappealing to users.

Additionally, circular drain plates are extremely difficult to neatly cover. Where tiling is used, which is the most common method for installing a floor covering in a shower area wet room, the installer must cut arcs into the tiles, which is a laborious process.

SUMMARY

The present invention seeks to provide a shower floor former assembly which obviates or reduces the above-mentioned problems.

According to a first aspect of the invention, there is provided a shower floor former assembly comprising: a shower floor former having a non-circular waste-plate receiver, a centre point of the waste-plate receiver being offset from a centre point of the shower floor former; and a drain waste plate which is dimensioned to be receivable in the waste-plate receiver, the drain waste plate having a drainage aperture therethrough, a centre point of the drainage aperture being offset from a centre point of the drain waste plate; wherein the drain waste plate is receivable in the waste-plate receiver in a first condition in which the centre point of the drainage aperture is offset relative to the centre point of the shower floor former; and wherein the drain waste plate is receivable in the waste-plate receiver in a second condition in which the centre point of the drainage aperture is coincident with the centre point of the shower floor former.

Firstly, a non-circular waste-plate receiver advantageously simplifies the application of a floor covering over the shower floor former. No curved edges must be created, and this is particularly advantageous when tiling the shower area. Furthermore, due to the dual offset of the drainage aperture and waste-plate receiver, there is always a condition which can be reached in which the drainage aperture can be centrally located in the shower floor former. This significantly improves the appearance of the finished shower area.

Preferably, the shower floor former may have a multi-faceted upper surface, and the drain waste plate has a complementarily multi-faceted upper surface.

Multi-faceted surfaces again reduce the need for the floor covering to be curved in any way. Instead, the faces can meet at linear edges, which greatly simplifies the process of tiling over the shower floor former.

Each face of the multi-faceted upper surface of the shower floor former may have a linear edge terminating at the waste-plate receiver.

A linear edge allows for direct abutment of a tile edge up against the waste-plate receiver, or even overlapping the waste-plate receiver and drain waste plate, which not only improves the appearance of the covered shower floor, but may also improve the watertightness since the tiles may cover any gaps between the shower floor former and drain waste plate more easily.

Optionally, the waste-plate receiver may have a shape having at four-fold symmetry or a multiple thereof.

With a waste-plate receiver having four-fold symmetry, at least some of the edges can be oriented to the linear edges of the shower floor former itself. This creates large regions of the shower floor former where no tiles or floor covering need to be cut to shape, again simplifying the installation procedure.

In a preferred embodiment, the waste-plate receiver may have an octagonal shape.

An octagon has a geometric shape which is highly suited to the present invention. The number of edges which must be cut when tiling over the shower floor former is limited, since the octagon is such a regular shape, whilst still providing for a versatile number of configurations in which the drainage aperture can be positioned to avoid joists during installation.

Optionally, the drain waste plate may be receivable in the waste-plate receiver in a total of seven different said first conditions.

A plurality of different conditions in which the drainage aperture is spaced away from the centre of the shower floor former significantly increases the likelihood of being able to avoid the position of an underlying joist, almost eliminating the need to make cuts into the joists in order to accommodate the shower waste.

Preferably, the drainage aperture may be circular.

It is preferred that the drainage aperture be dimensioned to fit with existing shower wastes, which are almost exclusively circular in shape.

Optionally, the shower floor former may have an upper surface which slopes towards the waste-plate receiver. Furthermore, the drain waste plate may have an upper surface which slopes towards the drainage aperture.

The sloping of the upper surfaces direct waste water into the correct drainage areas of the eventually-created shower floor area.

At least one base support member of the shower floor former may be flush to at least one base support member of the drain waste plate in the first and second conditions.

Providing the base support members to be flush to one another improves the ability to maintain a level condition of the assembly when installing directly onto joists.

Preferably, the centre point of the waste-plate receiver may be offset from the centre point of the shower floor former in two axes thereof.

The dual-axis offset of the waste-plate receiver significantly increases the number of positions for orienting the drain waste plate to avoid joists, since the centre of the drainage aperture can be moved in both lateral and longitudinal directions with ease.

A magnitude of the offset between the centre point of the waste-plate receiver relative to the centre point of the shower floor former may preferably be equal to a magnitude of the centre point of the drainage aperture relative to the centre point of the drain waste plate.

By matching the offsets on the shower floor former and the drain waste plate, it is possible to ensure that there is always a feasible condition in which the drain waste plate has its drainage aperture aligned to the centre point of the shower floor former. This has the advantage of producing an aesthetically pleasing symmetry for the shower waste once installed.

According to a second aspect of the invention, there is provided a method of installing a shower floor former assembly to avoid joists thereunder, the method comprising the steps of: a] providing a shower floor former assembly in accordance with the first aspect of the invention; b] placing the shower floor former in position onto one or more joists and, if the or each joist is aligned with the centre point of the waste-plate receiver, rotating the shower floor former so that the or each joist is offset relative to the centre point of the waste-plate receiver; and c] inserting the drain waste plate into the waste-plate receiver in the first or second condition such that the drainage aperture is spaced apart from the or each joist.

The method may further comprise a step d] of fitting a shower waste to the drain waste plate.

Selection of the optimum position of the drainage aperture by careful positioning of the shower floor former and drain waste plate can largely eliminate the need to cut into the joists in order to accommodate a shower waste. This reduces the installation burden to the installer of the shower.

Optionally, there may be a further step subsequent to step c] of fitting a floor covering over the shower floor former assembly.

Floor coverings are readily applied to the present shower floor former assembly, since there are no circular edges which need to be avoided.

Preferably, the floor covering may comprise one or more tiles.

Since there are no awkward circular edges on the shower floor former, the present invention is particularly suited for tiling applications, since the tiling process becomes much more straightforward than for rounded shower floor formers.

The at least one said tile may be abuttable to a linear edge terminating at the waste-plate receiver on an upper surface of the shower floor former.

Abutment of a tile to the linear edge of the waste-plate receiver can improve the ease with which tiling can be achieved, since the need to cut the tile to shape is removed for at least one edge.

Optionally, during step b], the shower floor former may be rotated by 180°.

The inversion of the orientation of the shower floor former can significantly increase the total number of possible drainage aperture positions available to the installer, vastly improving the chances of being able to avoid a joist during installation of the shower waste.

According to a third aspect of the invention there is provided a method of tiling a shower floor formed via a shower floor former assembly in accordance with the first aspect of the invention, the method comprising the steps of: a] installing tiles on the upper surface of the shower floor former so as to abut a linear edge of the waste-plate receiver; and b] installing tiles on the upper surface of the drain waste plate so as to abut a linear edge thereof, such that no tile bridges the upper surfaces of the drain waste plate and shower floor former.

The advantage of the linear interface between the drain waste plate and shower floor former is that tiles do not need to bridge the components. Since the slopes of the respective upper surfaces will be different, this greatly simplifies the installation process for tiling a shower floor.

According to a fourth aspect of the invention, there is provided a multi-part shower floor installation kit comprising: a shower floor body portion having a non-circular waste-plate receiver, a centre point of the waste-plate receiver being offset from a centre point of the shower floor body portion; and a drain waste plate which is dimensioned to be receivable in the waste-plate receiver, the drain waste plate having a drainage aperture therethrough, a centre point of the drainage aperture being offset from a centre point of the drain waste plate; wherein the drain waste plate is receivable in the waste-plate receiver in a first condition in which the centre point of the drainage aperture is offset relative to the centre point of the shower floor body portion; and wherein the drain waste plate is receivable in the waste-plate receiver in a second condition in which the centre point of the drainage aperture is coincident with the centre point of the shower floor body portion.

Preferably, the shower floor body portion is either a shower floor former or a shower tray.

BRIEF DESCRIPTION OF THE DRAWINGS

The invention will now be more particularly described, by way of example only, with reference to the accompanying drawings, in which.

DETAILED DESCRIPTION

Figure 1A:
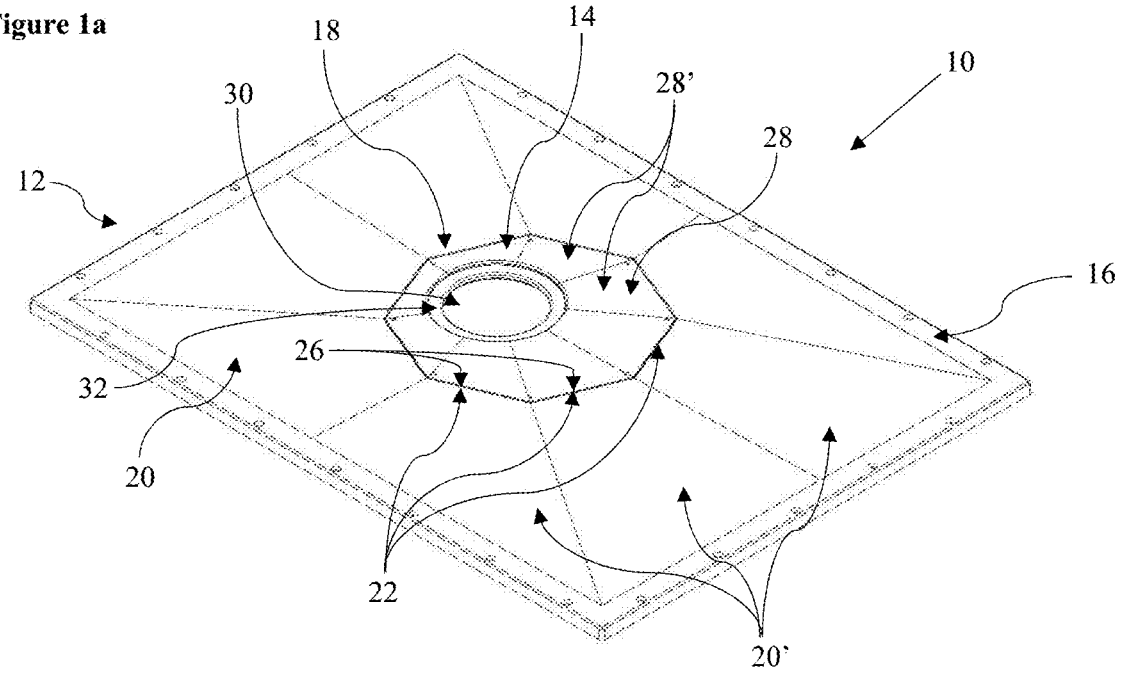
FIG. 1*a* shows a top isometric representation of one embodiment of a shower floor former assembly in accordance with the first aspect of the invention.

Referring to FIG. 1*a*, there is indicated a shower floor former assembly, indicated globally at 10, and which comprises a shower floor former 12 and an associated drain waste plate 14.

The term shower floor former 12 is intended to describe the component which forms the floor shape in a shower area, over which a floor covering is to be laid, such as tiles. A shower floor former 12 is therefore distinguished from a shower tray, which directly forms the watertight surface on which a user stands in the shower area.

The shower floor former 12 has a tray body 16 which defines a preferably rectilinear area in which the shower area is to be constructed. Within the tray body 16 is provided a waste-plate receiver 18 which here has an octagonal shape and within which the drain waste plate 14 is receivable.

The shower floor former 12 has an upper surface 20 onto which a floor covering can be mounted, and is here provided as a multi-faceted upper surface 20 having a number of faces 20' equal to the number of linear edges 22 of the waste-plate receiver 18. Each of these faces 20' preferably slopes towards the waste-plate receiver 18 to encourage water run-off once a floor covering is applied.

Where eight faces 20' are provided in a rectilinear tray body 16, it is preferred that the faces 20' be arranged as a quadrilateral each having one edge 24*a* which is equidistant between either the longitudinal or lateral parallel edges of the tray body 16, and one edge 24*b* which extends from the waste-plate receiver 18 to a corner of the tray body 16.

The drain plate 14 here has a regular octagonal perimeter, therefore having eight linear edges 26 which match to the linear edges 22 of the waste-plate receiver 18, and therefore allow the drain plate 14 to be inserted in position at any one of eight rotational positions. The drain plate 14 also therefore preferably has a multi-faceted upper surface 28, here having eight complementary faces 28', which also slope, preferably with the same gradient as the faces 20' of the shower floor former 12.

The drain plate 14 has a drainage aperture 30 which is preferably circular, and which is suitable for receiving a drain waste therethrough which can be connected to a plumbing system in the shower area. A seating lip 32 may be provided on the drain plate 14 for this purpose.

The waste-plate receiver 18 preferably includes an internal lip upon which the drain plate 14 is seatable, and both the drain plate 14 and waste-plate receiver 18 may be provided with pre-drilled locator holes via which fasteners or connectors may be engaged, such as bolts, to fix the drain plate 14 to the shower floor former 12.

Figure 1B:
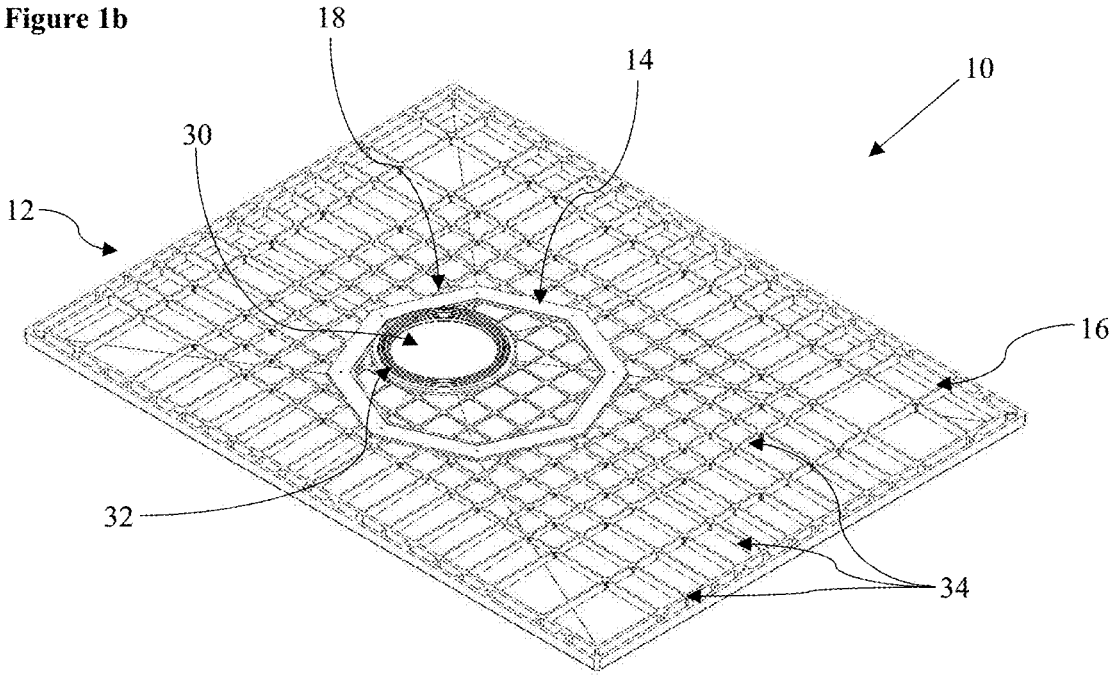
FIG. 1*b* shows a bottom isometric representation of the shower floor former assembly of FIG. 1*a;*

FIG. 1*b* shows the underside of the shower floor former assembly 10, in which the base support members 34 of the shower floor former 12 and the drain waste plate 14 can be seen. These are formed as longitudinal and lateral ribs or struts formed on the underside of each component, though it will be appreciated that the shower floor former 12 and/or the drain waste plate 14 could have a planar base plate instead, for example. The provision of the base support members 34 allows each of the shower floor former 12 and the drain waste plate 14 to sit flush relative to one another when mounted to a flooring joist.

Figure 2:
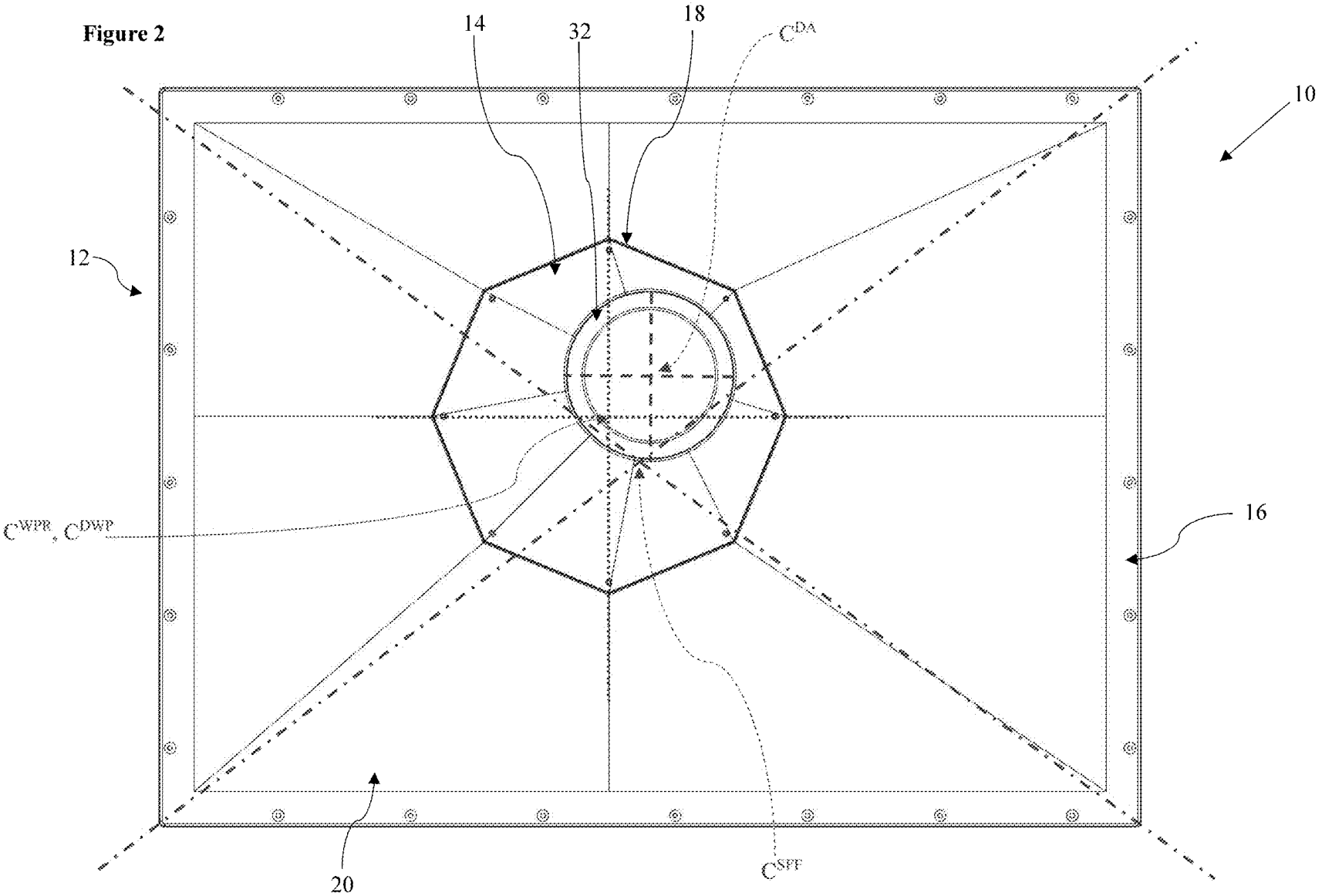
FIG. 2 shows a plan view of the shower floor former assembly, indicating the relevant centre points of the assembly.

The shower floor former 12 here has a rotationally-symmetric perimeter, and therefore a centre point $C^{SFF}$ of the shower floor former 12 is definable. In this instance, the centre point $C^{SFF}$ can be determined by the intersection of two imaginary lines extending from opposite corners of the tray body 16. It is noted that the edges 24*b* of the faces 20' of the shower floor former 12 are divergent with these imaginary lines. The centre point $C^{SFF}$ is outlined in detail in FIG. 2.

The centre point $C^{WPR}$ of the waste-plate receiver 18 is offset relative to the centre point $C^{SFF}$ of the shower floor former 12, preferably in two axes, that is, in axes parallel to both of the lateral and longitudinal edges of the shower floor former 12. This offset means that the shower floor former 12 is not, as a whole unit, rotationally symmetric.

The drain waste plate 14 itself has a centre point $C^{DWP}$ which is coincident with the centre point $C^{WPR}$ of the waste-plate receiver 18 when the drain waste plate 14 is inserted into the waste-plate receiver 18. The drain aperture 30 is not centrally located within the drain waste plate 14, and a centre point $C^{DA}$ of the drain aperture 30 is offset relative to the centre point $C^{DWP}$ of the drain waste plate 14.

For an octagonal drain waste plate 14, there is a total of eight configurations in which it can be received in the waste-plate receiver 18. However, since the shape of the shower floor former 12 is rotationally symmetric, but the position of the waste-plate receiver 18 prevents the whole shower floor former 12 from being so, a larger number of configurations is achievable by rotation of the shower floor former 12. For a rectilinear shower floor former 12, a 180° rotation of the shower floor former 12 is possible to double the total number of configurations, though a quadrupling can be achieved for a square shower floor former.

Figure 3:
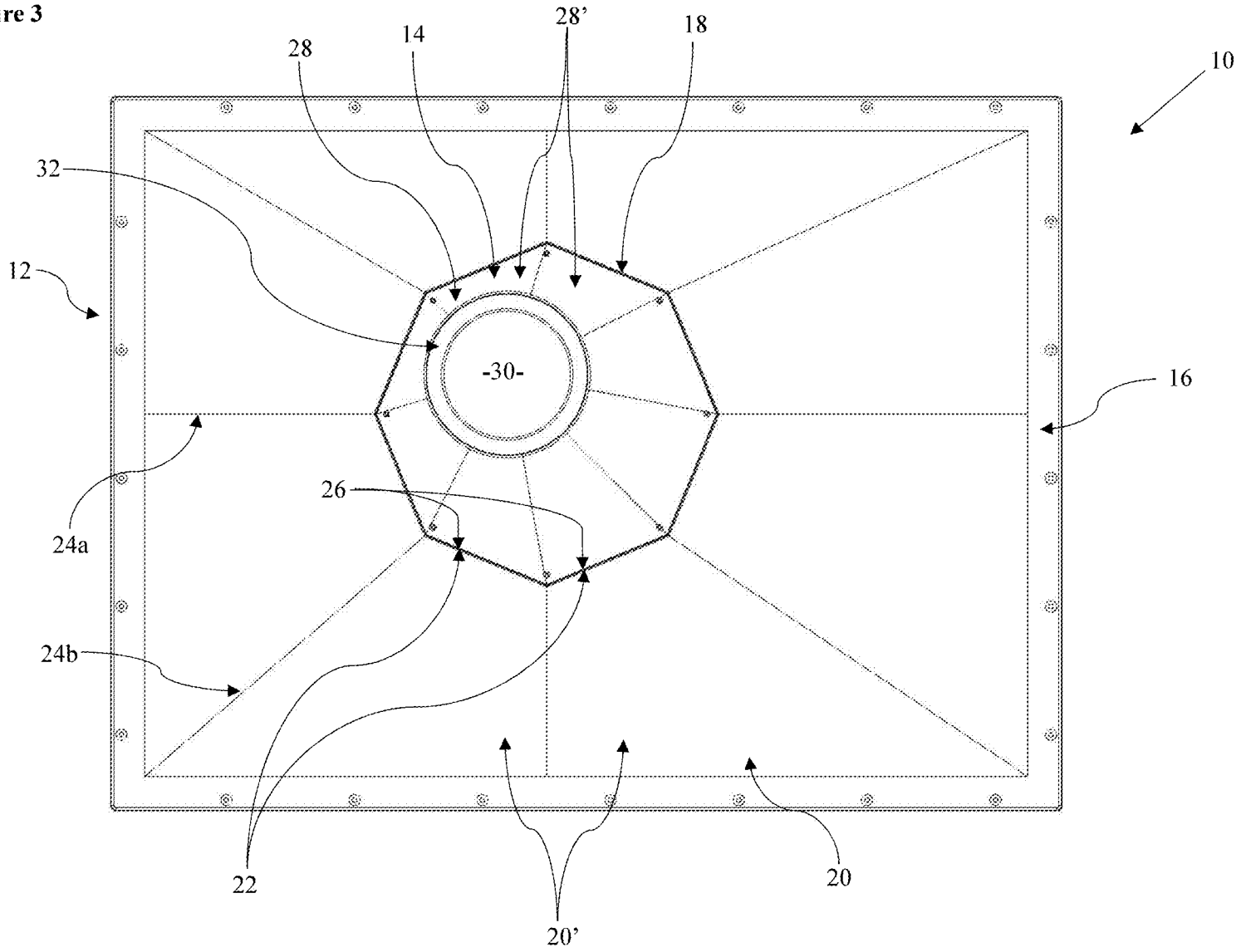
FIG. 3 shows a plan view of the shower floor former assembly of FIG. 1*a* in a first condition in which the centre point of the drainage aperture is offset relative to the centre point of the shower floor former.

A first indicative configuration of the shower floor former assembly 10 is shown in FIG. 3. The drain waste plate 14 is inserted so that each of the faces 28' of the upper surface 28 smoothly engage with a corresponding face 20' of the upper surface 20 of the shower floor former 12. The configuration shown is such that the centre point $C^{DA}$ of the drain aperture 30 is offset relative to the centre point $C^{SFF}$ of the shower floor former 12. There are six other configurations available in which the centre point $C^{DA}$ of the drain aperture 30 is offset relative to the centre point $C^{SFF}$ of the shower floor former 12, for a total of seven non-centred configurations.

Figure 4:
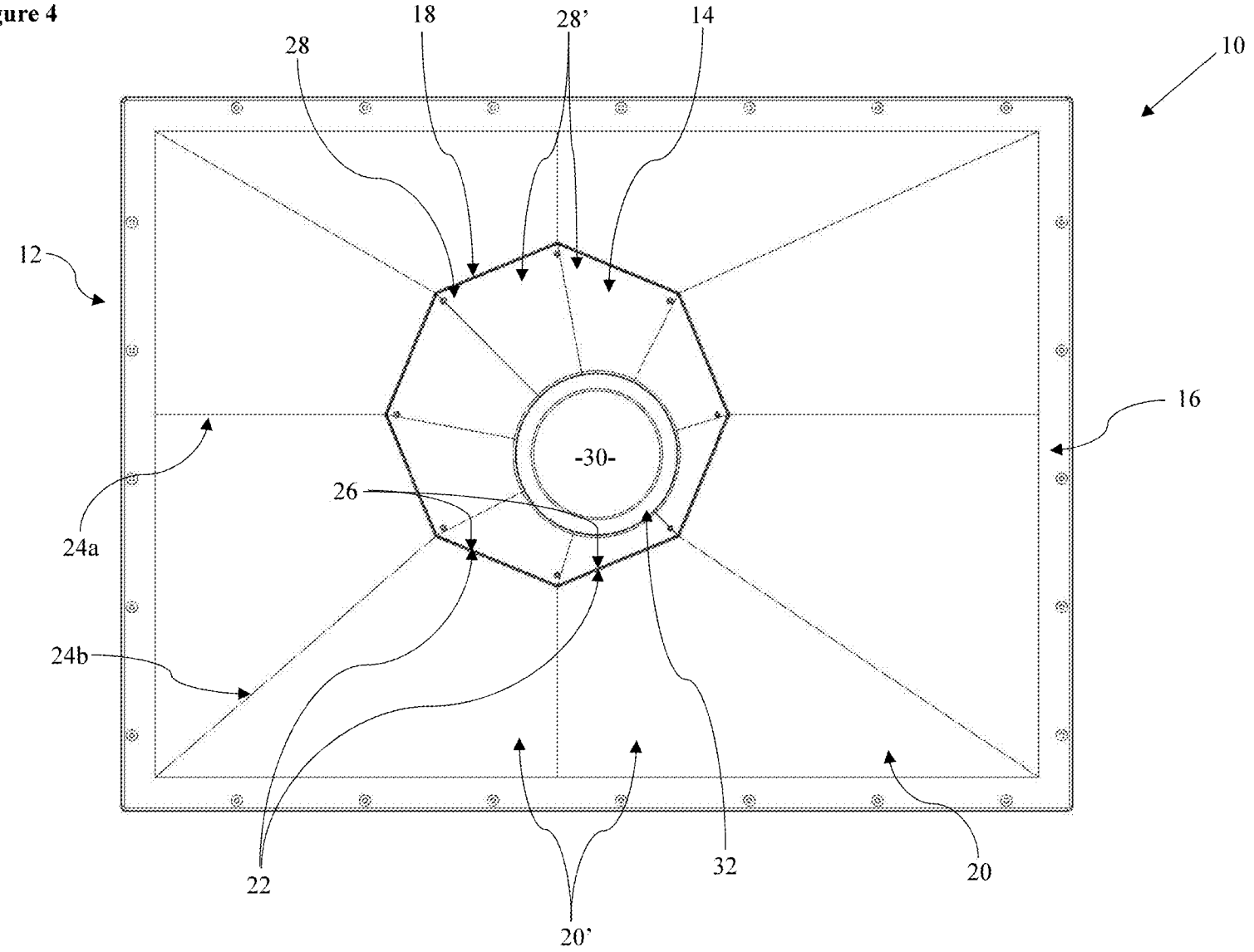
FIG. 4 shows a plan view of the shower floor former assembly of FIG. 1*a* in a second condition in which the centre point of the drainage aperture is coincident with the centre point of the shower floor former.

A second indicative configuration of the shower floor former assembly 10 is shown in FIG. 4. In this arrangement, since magnitude of the offset between the centre point $C^{WPR}$ of the waste-plate receiver 18 relative to the centre point $C^{SFF}$ of the shower floor former 12 is equal to a magnitude of the centre point $C^{DA}$ of the drainage aperture 30 relative to the centre point $C^{DWP}$ of the drain waste plate 14, it becomes possible to realign the drainage aperture 30 to the centre of the shower floor former 12. This cannot be achieved with a drain waste plate having an eccentric drainage aperture where the waste-plate receiver is centrally positioned on the shower floor former.

These possible arrangements provide numerous advantages during installation of the shower floor former 10, which will now be explained with reference to FIGS. 5*a* to 5*g*.

Figure 5A:
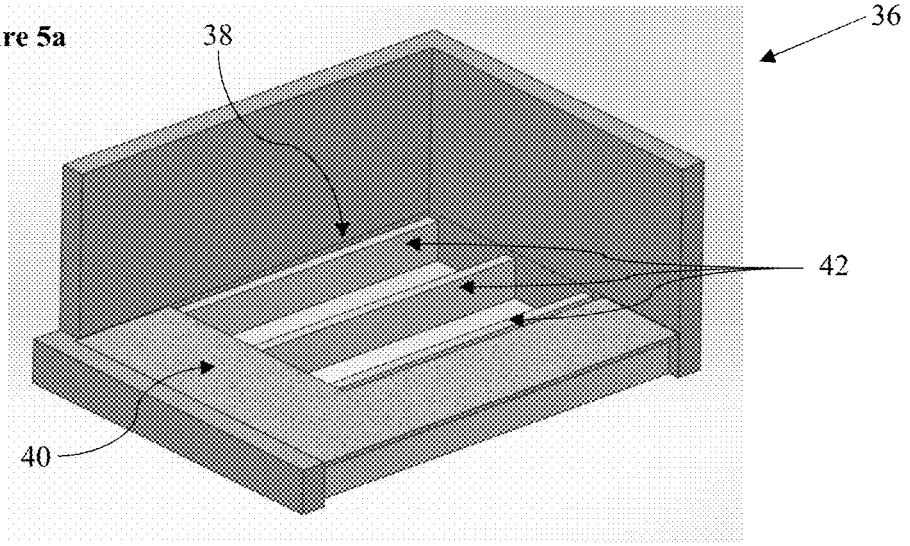
FIG. 5*a* shows an isometric representation of a shower area in which a shower floor is to be installed.
Figure 5B:
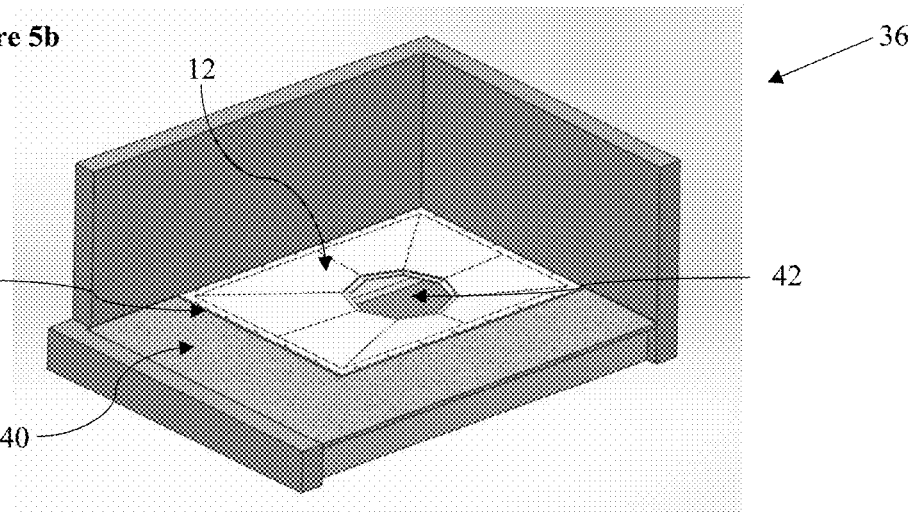
FIG. 5*b* shows the shower area of FIG. 5*a* following positioning of the shower floor former of the shower floor former assembly of FIG. 1*a;*

A shower area 36 can be provided having a cut-out portion 38 of flooring 40 into which the shower floor former 12 is insertable directly onto the underlying joists 42, as per FIG. 5*a*. The orientation of the shower floor former 12 can then be selected based on its suitability, as shown in FIG. 5*b*.

The dimensioning of the drain waste plate 14 and drainage aperture 30 are such that there will likely always be some overlap between the drainage aperture 30 and the centre point $C^{SFF}$ of the shower floor former 12. It is therefore important to ensure that there is no corresponding overlap between an underlying joist 42 and the centre point $C^{SFF}$ of the shower floor former 12 when installing the shower floor former 12. This can be ensured by rotation of the shower floor former 12 during installation until there is no said overlap. The rotational asymmetry of the waste-plate receiver 18 means that, once the shower floor former 12 is rotated, the position of the waste-plate receiver 18 relative to the joists 42 will be altered, allowing a suitable position to be found.

Figure 5C:
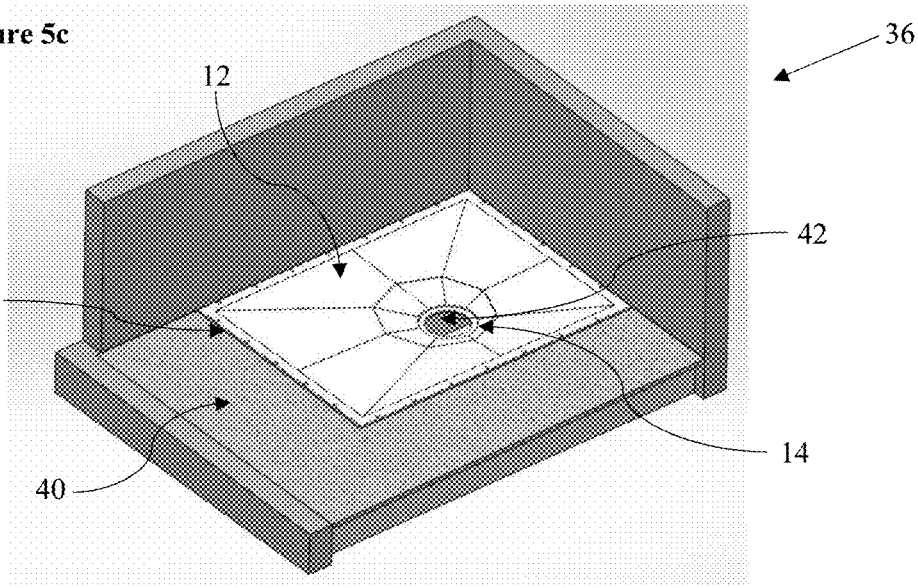
FIG. 5*c* shows the shower area of FIG. 5*b* following installation of the drain waste plate in a first condition which is different to that shown in FIG. 3.

Provided that no joist 42 directly overlaps the centre point $C^{SFF}$ of the shower floor former 12, a suitable configuration of the drain waste plate 14 can be found which positions the drainage aperture 30 away from the joist 42, as shown in FIG. 5*c*. The octagonal arrangement of the present embodiment has sufficient configurations available to permit this to be the case without the need to resort to a circular waste-plate receiver, which is extremely difficult to tile.

Figure 5D:
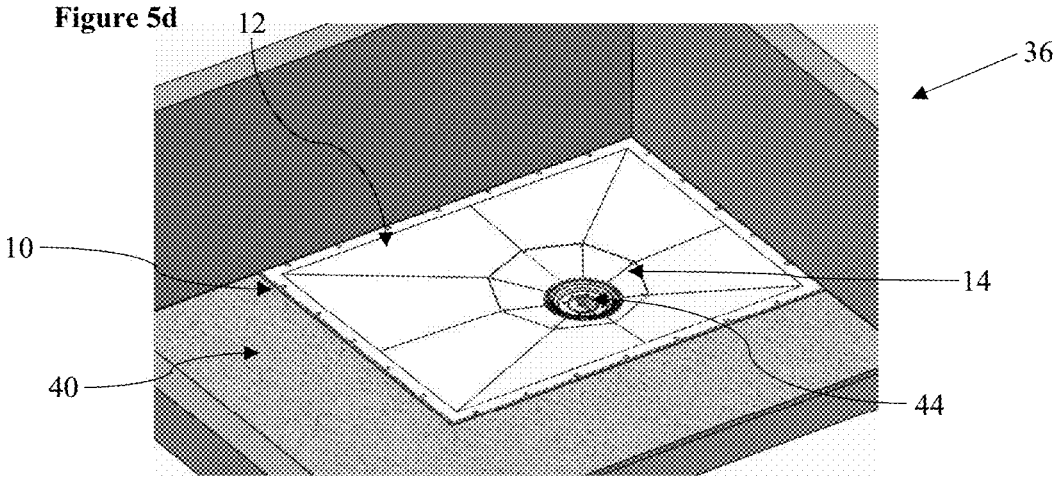
FIG. 5*d* shows the shower area of FIG. 5*c* following installation of a shower waste.

Once a suitable drain waste plate 14 position has been found, a shower waste 44 can be installed, such as that of FIG. 5*d*, safe in the knowledge that there is no need to cut out a portion of any joist 42 which might weaken the support of the floor.

Figure 5E:
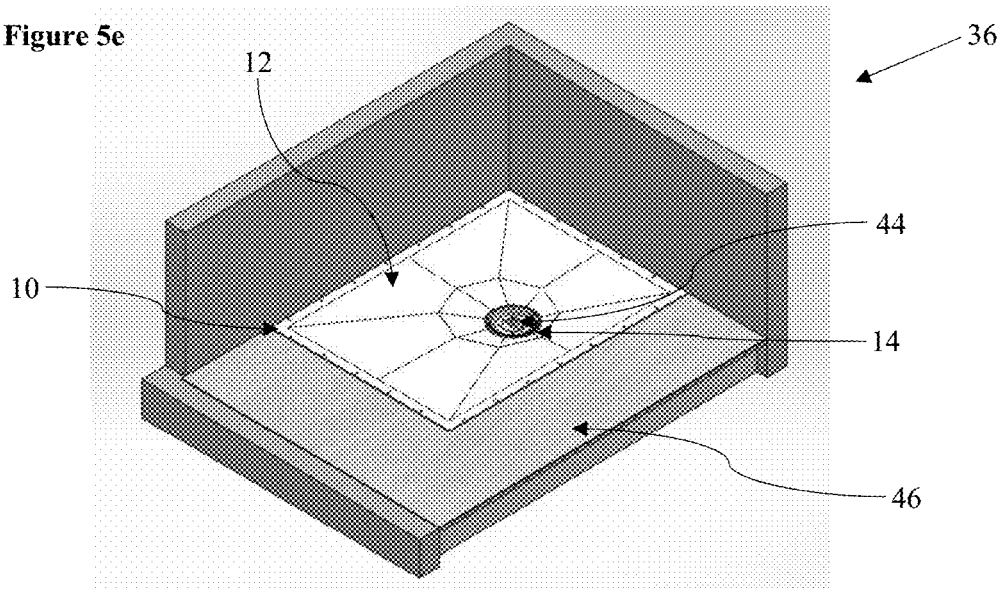
FIG. 5*e* shows the shower area of FIG. 5*d* following installation of a floor abutting the shower floor former.

With the shower floor former assembly 10 installed, a suitable floor 46 can be installed, as shown in FIG. 5*e*, which sits flush to the edge of the tray body 16 of the shower floor former 12. A floor covering 48 can then be applied over the floor 46 and shower floor former assembly 10, such as tiles or a waterproof sheet or film, such as a plastic membrane or similar vinyl covering, to provide a suitably water-resistant floor which is able to direct run-off water into the shower waste 44. This can be seen in FIG. 5*f*. The shower floor can then be finished by installation of a waste cap 50, as shown in FIG. 5*g*.

Figure 5F:
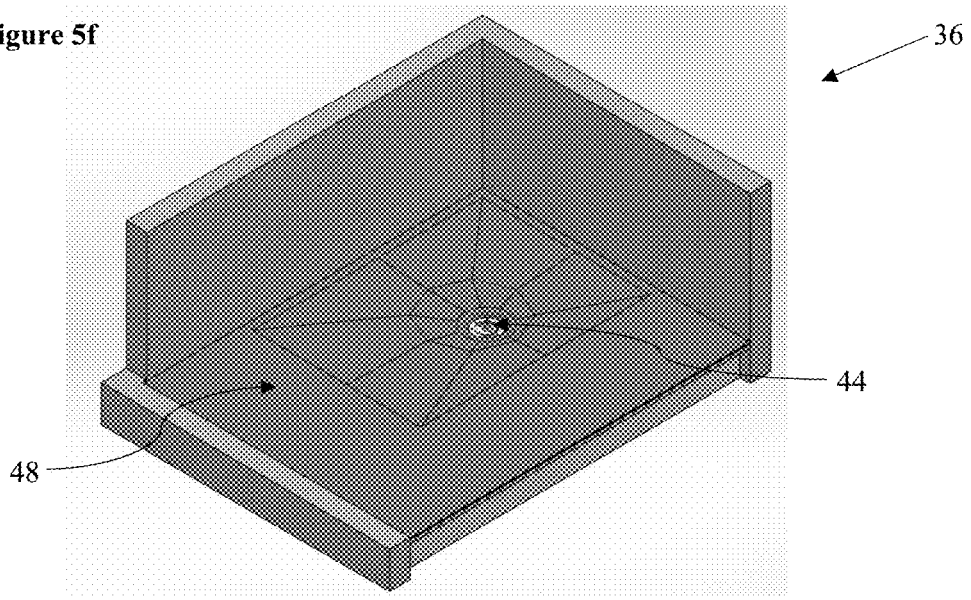
FIG. 5*f* shows the shower area of FIG. 5*e* following installation of a floor covering.
Figure 5G:
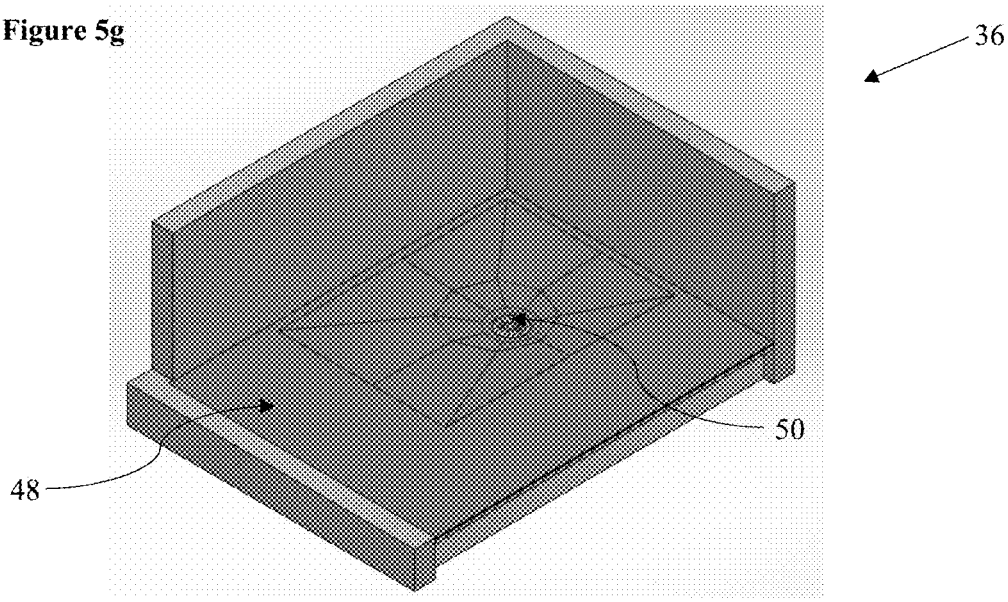
FIG. 5*g* shows the shower are of FIG. 5*f* following installation of a waste cover.

A vinyl style floor covering is shown in FIGS. 5*f* and 5*g*. However, were tiles to be used, the installer could tile along the upper surface 20 of the shower floor former 12, until the edge of the tile abutted the linear edge 22 of the waste-plate receiver 18. The upper surface 28 of the drain waste plate 14 can then also be tiled, with the tiles abutting the linear edge 26 of the drain plate. This eliminates the need to bridge the discontinuity in the slope between the drain waste plate 14 and the shower floor former 12, which is a significant problem for circular drain waste plates.

Figure 6:
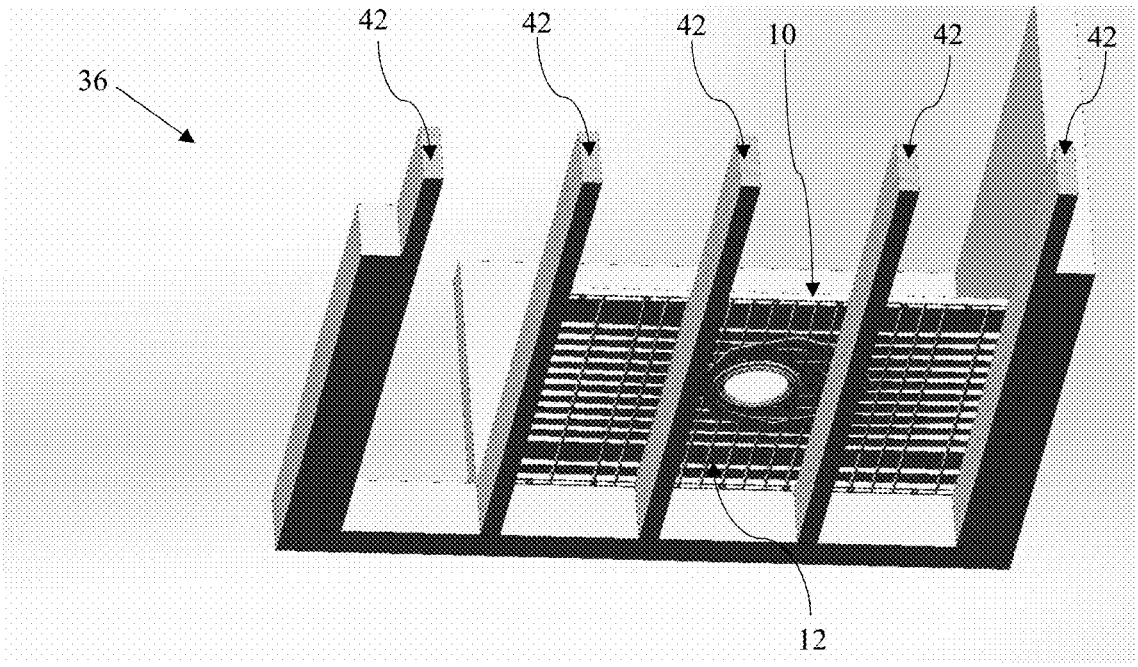
FIG. 6 shows a bottom isometric representation of a shower area having a shower floor former assembly in accordance with the first aspect of the invention indicating a joist position relative to the drainage aperture.

An indicative representation of the shower floor former assembly 10 is shown in FIG. 6 from below, and shows how the spacing of joists 42 relative to the drain aperture 30 is such that, provided that sufficient configurations are permitted to the drain waste plate 14, there should in theory always be a position in which the drain aperture 30 is positionable so as to sit between joists 42. Where there is an offset in two axes of the shower floor former 12 for the waste-plate receiver 18, this ensures that this will be true for both laterally and longitudinally aligned joists 42.

Whilst an octagonal drain waste plate is shown in the embodiment described above, it will be appreciated that alternative non-circular geometries could be utilised. Four-fold symmetry is preferred, and therefore a square drain waste plate would work acceptably, albeit with fewer viable orientations in the waste plate receiver, and a drain waste plate having twelve-fold symmetry would also work, for example. This would, however, increase the complexity of manufacture of the shower floor former assembly.

The present invention could feasibly be used in other shower floor arrangements, such as in shower trays. A multi-part shower floor installation kit could therefore be provided which comprises a shower floor body portion, such as a shower tray, which has a non-circular waste-plate receiver. A corresponding drain waste plate could then be included as per the shower floor former arrangement.

It is therefore possible to provide a shower floor former assembly which can be readily installed into a shower area so that the drainage aperture, and therefore shower waste, is positionable away from any joists thereunder. This is achieved by the offsetting of the waste plate receiver from the centre of the tray, and the drainage aperture from the centre of the drain waste plate. The non-circularity of the waste plate receiver significantly reduces the difficulty in tiling over the shower floor former once installed. This arrangement also has the advantage of being able to create a centrally positioned drainage aperture, unlike other eccentric arrangements.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A shower floor former assembly comprising:

a shower floor former having a non-circular waste-plate receiver, a centre point of the waste-plate receiver being offset from a centre point of the shower floor former;

the shower floor former having a multi-faceted upper surface, wherein each face of the multi-faceted upper surface of the shower floor former has a linear edge terminating at the waste-plate receiver, the said linear edges being co-planar with one another so that each face of the multi-faceted upper surface terminates in an in-use horizontal plane;

a drain waste plate which is dimensioned to be receivable in the waste-plate receiver, the drain waste plate having a drainage aperture therethrough, a centre point of the drainage aperture being offset from a centre point of the drain waste plate, the drain waste plate having a complementarily multi-faceted upper surface to that of the shower floor former;

wherein the drain waste plate is received in the waste-plate receiver in a first condition in which the centre point of the drainage aperture is offset relative to the centre point of the shower floor former; and wherein the drain waste plate is received in the waste-plate receiver in a second condition in which the centre point of the drainage aperture is coincident with the centre point of the shower floor former.

2. The shower floor former assembly as claimed in claim 1, wherein the waste-plate receiver has a shape having a four-fold symmetry or a multiple thereof.

3. The shower floor former assembly as claimed in claim 2, wherein the waste-plate receiver has an octagonal shape.

4. The shower floor former assembly as claimed in claim 3, wherein the drain waste plate is receivable in the waste-plate receiver in a total of seven different said first conditions.

5. The shower floor former assembly as claimed in claim 1, wherein the drainage aperture is circular.

6. The shower floor former assembly as claimed in claim 1, wherein the shower floor former has an upper surface which slopes towards the waste-plate receiver.

7. The shower floor former assembly as claimed in claim 1, wherein the drain waste plate has an upper surface which slopes towards the drainage aperture.

8. The shower floor former assembly as claimed in claim 1, wherein at least one base support member of the shower floor former is flush to at least one base support member of the drain waste plate in the first and second conditions.

9. The shower floor former assembly as claimed in claim 1, wherein the centre point of the waste-plate receiver is offset from the centre point of the shower floor former in two axes thereof.

10. The shower floor former assembly as claimed in claim 1, wherein a magnitude of the offset between the centre point of the waste-plate receiver relative to the centre point of the shower floor former is equal to a magnitude of the centre point of the drainage aperture relative to the centre point of the drain waste plate.

11. The shower floor former assembly as claimed in claim 1, wherein the drain waste plate is provided as a unitary component.

12. The shower floor former assembly as claimed in claim 1, wherein each face of the multi-faceted upper surface is or is substantially trapezoidal.

13. A shower floor former assembly comprising:

a shower floor former having a non-circular waste-plate receiver, a centre point of the waste-plate receiver being offset from a centre point of the shower floor former;

the shower floor former having a multi-faceted upper surface, wherein each face of the multi-faceted upper surface of the shower floor former has a linear edge terminating at the waste-plate receiver, the said linear edges being co-planar with one another so that each face of the multi-faceted upper surface terminates in an in-use horizontal plane; and a drain waste plate which is dimensioned to be receivable in the waste-plate receiver, the drain waste plate having a drainage aperture therethrough, a centre point of the drainage aperture being offset from a centre point of the drain waste plate, the drain waste plate having a complementarily multi-faceted upper surface to that of the shower floor former;

wherein the drain waste plate is receivable in the waste-plate receiver in at least one condition in which the centre point of the drainage aperture is offset relative to the centre point of the shower floor former.

* * * * *